US008344840B2

(12) United States Patent
Zillmann et al.

(10) Patent No.: US 8,344,840 B2
(45) Date of Patent: Jan. 1, 2013

(54) TRANSFORMER

(75) Inventors: Karl-Heinz Zillmann, Marsberg (DE); Wolfgang Mö nig, Brilon (DE); Benjamin Weber, Winterberg (DE)

(73) Assignee: ABB Technology AG, Zurich (CH)

( * ) Notice: Subject to any disclaimer, the term of this patent is extended or adjusted under 35 U.S.C. 154(b) by 71 days.

(21) Appl. No.: 13/095,360

(22) Filed: Apr. 27, 2011

(65) Prior Publication Data

US 2011/0221556 A1 Sep. 15, 2011

Related U.S. Application Data

(63) Continuation of application No. PCT/EP2009/006785, filed on Sep. 19, 2009.

(30) Foreign Application Priority Data

Oct. 28, 2008 (EP) ..... 08018770

(51) Int. Cl.
*H01F 17/04* (2006.01)

(52) U.S. Cl. ..... 336/170

(58) Field of Classification Search ..... 336/170, 336/173, 180–184, 214–215, 212, 234
See application file for complete search history.

(56) References Cited

U.S. PATENT DOCUMENTS

| | | | | |
|---|---|---|---|---|
| 3,579,165 | A * | 5/1971 | Johnson | 336/170 |
| 5,177,460 | A * | 1/1993 | Dhyanchand et al. | 336/12 |
| 5,182,535 | A * | 1/1993 | Dhyanchand | 336/12 |
| 5,355,296 | A * | 10/1994 | Kuo et al. | 363/43 |
| 6,208,230 | B1 | 3/2001 | Shiota | |

FOREIGN PATENT DOCUMENTS

JP 2000-243636 A 9/2000

OTHER PUBLICATIONS

International Search Report (PCT/ISA/210) issued on Nov. 13, 2009, by European Patent Office as the International Searching Authority for International Application No. PCT/EP2009/006785.

* cited by examiner

*Primary Examiner* — Tuyen Nguyen
(74) *Attorney, Agent, or Firm* — Buchanan Ingersoll & Rooney PC

(57) ABSTRACT

A transformer is provided with at least one core leg on which three windings are arranged side by side, whose discharges are designed to be mutually insulated. Each winding is formed by a near-core low-voltage winding, which are each wound by an associated high-voltage winding, and the discharges of the low-voltage windings are axially designed, so that the lateral spacing of the windings to each other is minimized.

21 Claims, 2 Drawing Sheets

TRANSFORMER

RELATED APPLICATION

This application claims priority as a continuation application under 35 U.S.C. §120 to PCT/EP 2009/006785, which was filed as an International Application on Sep. 19, 2009 designating the U.S., and which claims priority to European Application 08018770.1 filed in Europe on Oct. 28, 2008. The entire contents of these applications are hereby incorporated by reference in their entireties.

FIELD

The present disclosure relates to a transformer. More particularly, the present disclosure relates to a transformer having at least one core limb on which three windings are arranged beside one another, where the outgoing lines of the windings are each routed out in a manner insulated from one another.

BACKGROUND INFORMATION

Transformers which are needed for power converters, e.g., rectifiers or inverters, each have a plurality of windings which include a low-voltage winding and a high-voltage winding and which are used to transform the respective two-phase or three-phase AC voltage to the desired voltage level.

A current which has been rectified in this manner regularly has residual ripple, that is to say a still remaining AC voltage component of a smoothed or regulated supply voltage after the latter has been rectified by a rectifier and smoothed by a capacitor and/or has been reduced to a lower level by a voltage regulator.

In order to reduce this residual ripple further, 12-phase, 18-phase and 24-phase rectifier circuits are often used. As a result, it is often possible to entirely dispense with a smoothing capacitor. Another advantage is the virtually sinusoidal input current and the resultant low mains/transformer load with distortive reactive power. The transformer which is more complicated to wind and secondarily has a delta winding and a star winding each with the same pole voltage is disadvantageous. This arrangement results in a phase shift of 30° with 12 phases. For a phase shift of 20° with 18 phases or 15° with 24 phases, two adjacent phases must be correspondingly added, as a result of which the required transformer becomes even more complicated, since one complete winding, that is to say a low-voltage winding and a high-voltage winding, with a separate outgoing line is respectively required for each phase.

If such windings are arranged beside one another on a common limb, a sufficiently large intermediate space, which is accordingly needed space for the required insulated routing-out of the winding conductors, needs to be provided between the windings which are arranged beside one another. This results in a corresponding spatial extent of these transformers combined with a corresponding space requirement.

However, the space required thereby is often not available, which either results in considerable space problems or allows only simpler circuit variants which are associated with the disadvantage of undesirable residual ripple, that is to say remnants of AC voltage.

On the basis of the known techniques described above, exemplary embodiments of the present disclosure provide a transformer of the type mentioned at the outset, which transformer allows better use of space by means of technical measures and thus allows the largest possible number of windings to be arranged with the smallest possible physical volume.

SUMMARY

An exemplary embodiment provides a transformer which includes at least one core limb, and three windings arranged beside one another on the at least one core limb. The windings have outgoing lines which are each routed out in a manner so as to be insulated from one another. Each winding is formed by a low-voltage winding which is close to the core and respectively has an associated high-voltage winding wound around the corresponding low-voltage winding. The outgoing lines of the low-voltage windings are axially routed out to minimize the lateral distance between the windings.

BRIEF DESCRIPTION OF THE DRAWINGS

Additional refinements, advantages and features of the present disclosure are described in more detail below with reference to exemplary embodiments illustrated in the drawings, in which:

FIG. 3 shows a cross section through a winding according to the section line A-A in FIG. 2 with outgoing lines of the low-voltage windings which have been routed through.

DETAILED DESCRIPTION

Figure 1:
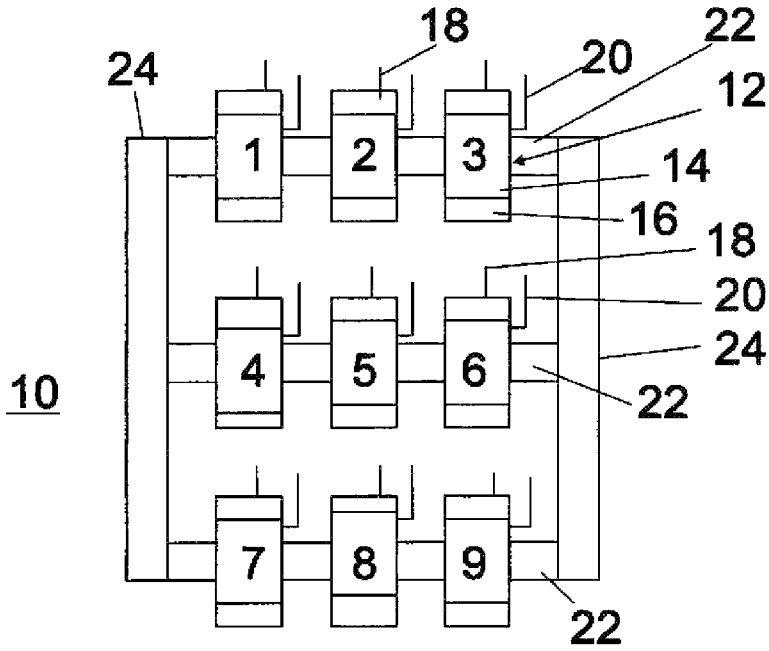
FIG. 1 shows a diagrammatic illustration, from the side, of a transformer having a known winding arrangement.

Exemplary embodiments of the present disclosure provide a transformer in which each winding is formed by a low-voltage winding which is close to the core and respectively has an associated high-voltage winding wound around it. Exemplary embodiments provide that the axial distance between the windings is minimized, and the outgoing lines of the low-voltage windings are axially routed out. In this case, the outgoing lines of the high-voltage windings can always be routed to the outside in a radial direction.

Exemplary embodiments of the present disclosure provide a solution to the space problem, as noted above with respect to known techniques, by reducing the axial distance between three windings, which are each arranged beside one another on a core limb, to a minimum which is determined by the required insulating distance between the windings and the resultant mutual influence as a result of electrical reactions.

This arrangement is enabled by the fact that the outgoing lines of the low-voltage windings are not routed out in a radial direction as is the case with known techniques, which considerably increases the axial distance between windings. On the contrary, according to an exemplary embodiment of the present disclosure, the outgoing lines of the low-voltage windings are axially routed out, that is to say parallel to the winding axis, in the region between the low-voltage winding and the high-voltage winding.

It has advantageously proved to be particularly favorable in this case that the outgoing lines which are routed out axially, that is to say parallel to the winding axis or to the core limb, are each provided with a shrink tube as insulation and as protection. This insulation is designed in a manner corresponding to the electrical loads, for example with a rated voltage of 2 kV, a test voltage of 20 kV and an impulse voltage of 60 kV for a total power of approximately 5 MVA, and can have an insulating thickness (e.g., wall thickness) of at least 5 mm, e.g., 6 mm, that is to say a total of 12 mm, to which the conductor thickness is added.

In order to achieve an installation-friendly design, an exemplary embodiment of the present disclosure provides for the outgoing lines of the low-voltage windings to be routed out parallel to the core limb on one side, that is to say all electrical connections of the low-voltage windings are arranged on one side of the transformer designed in this manner.

According to another exemplary embodiment of the present disclosure, the outgoing lines of one low-voltage winding arranged on the outside are routed out to one side, and the outgoing lines of the two other low-voltage windings are routed out to the opposite side axially parallel to the core limb. This refinement is considered, for example, when sufficient space is available.

For reasons of symmetry with respect to the electrical and mechanical properties, a circular winding shape can be utilized. If the outgoing lines of the inner low-voltage windings are now routed to the outside in an axial manner, that is to say parallel to the winding axis, along the circumference, imperfections may result on the circumference and, in the case of the high-voltage windings wound thereon on the outside, may lead to local deviations from the circular shape, for example, to egg-shaped winding cross sections.

In this case, it has proved to be advantageous that the outgoing lines of the low-voltage windings are routed out parallel to the core limb in a manner offset by 120° relative to one another on the circumference. This at least approximately homogenizes the winding circumference. At the same time, the risk of possible mutual electrical influence can be decisively reduced by the spatial distribution of the outgoing lines of the different low-voltage windings on the circumference.

As an alternative to the circular shape, another exemplary embodiment of the present disclosure provides that a rectangular shape or an oval shape can also be used for the design of the coil cross section. However, a winding geometry which is as uniform as possible is advantageously sought in this case.

In order to obtain the most uniform possible shape of every complete winding, that is to say including a low-voltage winding and a high-voltage winding, an exemplary embodiment of the present disclosure provides for shell-like spacers made of insulating material to be arranged in a manner distributed uniformly over the circumference in the region between the partial windings, that is to say between the low-voltage winding and the high-voltage winding.

These spacers can be used to fill the space which is not occupied by a winding outgoing line and thus compensate for any deviation of the winding from the uniform shape sought and thus avoid undesirable deviations being produced at all in the first place. The thickness of these insulating shells is accordingly such that it corresponds approximately to the thickness of an outgoing line.

According to an exemplary embodiment, each of the shell-like spacers arranged between the windings can have such a width in the circumferential direction that a gap respectively remains between spacing shells which are adjacent based on the circumference, into which gap the relevant outgoing line can be inserted. In this case, such a spacing shell extends at most over the circumference such that an uncovered remaining area, the width of which corresponds to that of three outgoing lines, results in the case of three spacing shells, for example.

If appropriate, these insulating shells may be designed in a modular manner or using building blocks, with the result that the respective position of the relevant outgoing line has already been predefined when producing a winding. For example, in order to route out the respective outgoing lines on one side, provision may be made for the winding circumference no intermediate space, apart from its own outgoing line, to be provided for the first winding which is furthest from the connection side, for one intermediate space each for the first and central outgoing lines to be provided for the next, central winding and for a total of three intermediate spaces to be provided for the third winding which is closest to the connection side. In this case, the respectively provided intermediate spaces are aligned with the associated intermediate spaces between the adjacent windings.

According to another exemplary embodiment of the present disclosure, gaps for cooling channels may also be provided in the shell-like spacers parallel to the intermediate spaces for the respective outgoing lines of the low-voltage windings, through which cooling channels a gas, for example, air, or another fluid flows or circulates as coolant.

According to another exemplary embodiment of the present disclosure, it proves to be expedient to embed the complete windings, that is to say the windings formed from a low-voltage winding and a high-voltage winding, with synthetic resin together with the insulation of the outgoing lines, with the result that there is no need to deal with any damage or impairment of the individual windings after the complete winding has been finished.

In principle, the transformer according to the present disclosure may have three or more core limbs which are each provided with three or more, e.g., four, low-voltage windings arranged beside one another and high-voltage windings wound on the latter, the ends of which limbs are each connected by means of yokes. In this case, it proves to be advantageous to arrange the individual core limbs beside one another in a common plane.

In the case of four or more windings for each core limb, the outgoing lines are likewise routed out to the side, as already explained above, on the circumference of the respective low-voltage winding, to be precise either only to one side or symmetrically to both sides, for example.

FIG. 1 shows a diagrammatic illustration, from the side, of a transformer 10, for example for use for rectifiers or inverters, which is formed with a known arrangement of windings 1 to 9 in which three windings 12 are respectively arranged beside one another on a common core limb 22. A total of three core limbs 22, which each have windings 12 denoted with the numbers 1 to 9 wound around them, are provided. The windings 12 each include a low-voltage winding 14 and a high-voltage winding 16 which radially adjoins the latter.

In the example of the known technique shown in FIG. 1, the core structure of the transformer includes three core limbs 22 which are arranged parallel to one another and at the ends of which a continuous yoke 24 respectively closes the magnetic circuit.

In this case, the windings 12 which are each arranged on a core limb 22 are at such a distance from one another that sufficient insulation for the outgoing lines 20 of the low-voltage windings 14, which are radially routed out therebetween, is ensured. The outgoing lines 18 of the high-voltage windings 16 are likewise radially routed out on the outer circumference of each winding 12.

However, this design is not very space-saving and a considerable amount of space is required for such a transformer. Space is generally scarce and is often well used, and so there is a desire for smaller dimensions for such transformers.

Figure 2:
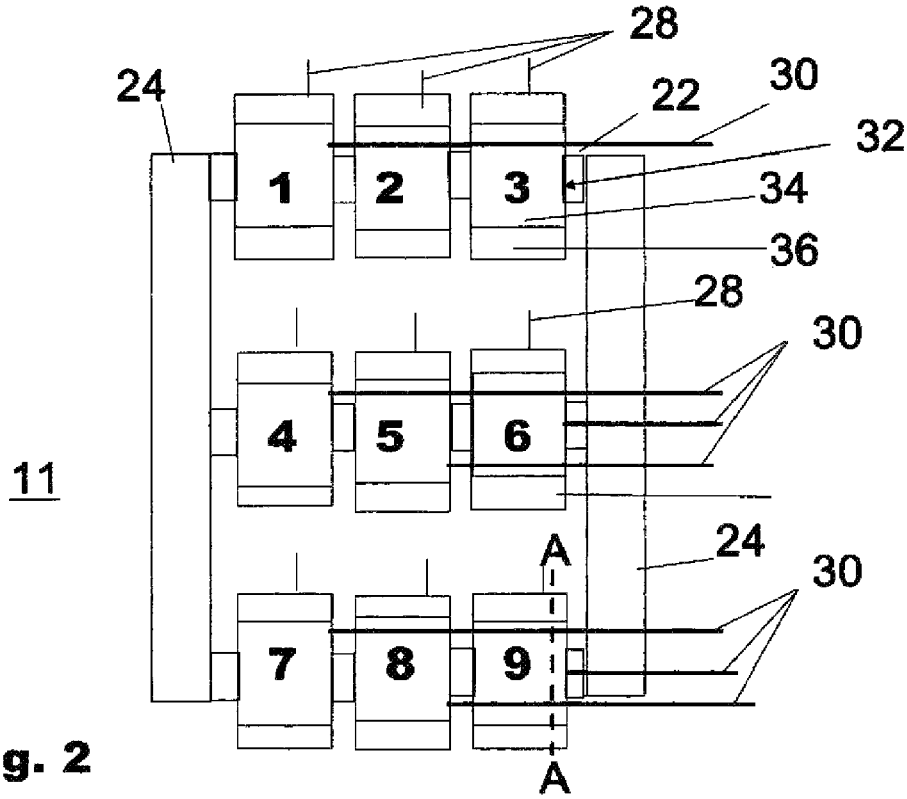
FIG. 2 shows a transformer according to an exemplary embodiment of the present disclosure with three windings which are arranged beside one another on a core limb.

In view of these drawbacks with the known technique, FIG. 2 provides a diagrammatic illustration, from the side, of a transformer 11 according to an exemplary embodiment of the present disclosure.

The transformer 11 shown in FIG. 2 can likewise be used for rectifiers and/or inverters and accordingly can have a total of nine windings 32 which, similar to the transformer 10 shown in FIG. 1, are denoted with numbers 1 to 9.

Each of the three windings 32 which are respectively arranged beside one another includes a low-voltage winding 34 and a high-voltage winding 36 which is radially wound onto the outside of the latter and through the center of which a core limb 22 reaches. The core limb 22 is mechanically connected to a yoke 24 at each of the two ends and thus closes the magnetic circuit.

In this case, the outgoing lines 28 of the high-voltage winding 36 are each radially routed to the outside, whereas the outgoing lines 30 of the low-voltage winding 34 are each routed to one side on the circumference thereof in an axial manner, that is to say parallel to the winding axis thereof or parallel to the direction of extent of the core limbs 22 of the transformer 11, in the region between the low-voltage winding 34 and the high-voltage winding 36.

Figure 3:
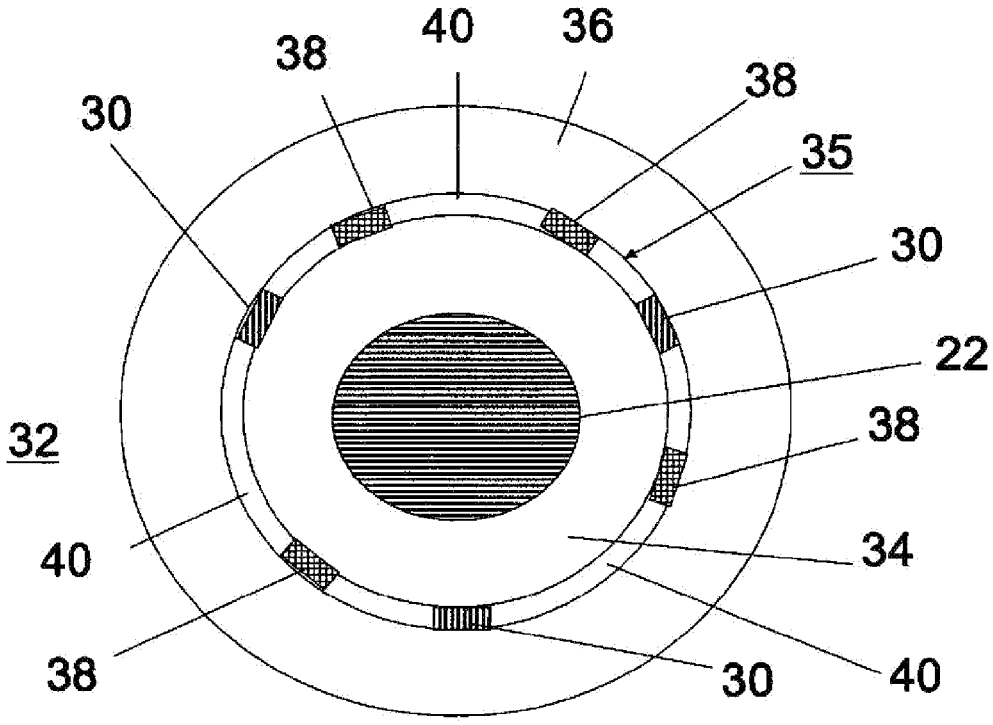

FIG. 3 shows a sectional view of the cross section of a winding 32 along section line A-A in FIG. 2, in which the above-mentioned region between the low-voltage winding 34 and the high-voltage winding 36 can be seen in the form of an annular gap 35.

This region which is referred to as an annular gap 35 and in which the outgoing lines 30 are routed out is provided for reasons of electrical insulation between the two partial windings, namely the low-voltage winding 34 and the high-voltage winding 36, which are at different voltage levels. In addition, the outgoing lines 30 are also insulated from the other windings 32. This leads to a height of the annular gap 35 of at least 20 mm, for example, in which the outgoing lines 30 run and which is, for the rest, filled with insulating material in the form of spacers 38.

According to an exemplary embodiment of the present disclosure, the respective outgoing lines 30 of the low-voltage windings 34 of the windings 32 arranged beside one another on a common core limb 22 are axially routed through in this annular gap 35 which is indicated in more detail in FIG. 3.

As can be clearly seen in FIG. 2, an exemplary embodiment of the present disclosure provides that it is possible to considerably reduce the lateral distance between the windings 32 on account of the arrangement of the outgoing lines 30 axially parallel to the winding axis or to the longitudinal axis of the core limb 22, which results in a considerably smaller width of the transformer 11, in comparison with known transformers 10 (see FIG. 1), with the same performance data.

FIG. 3 represents a sectional illustration through a winding 32 along the section line A-A indicated in FIG. 2. It first of all shows a low-voltage winding 34 around a central core 22. The region which has likewise already been mentioned and is referred to as an annular gap 35 adjoins the winding. The axially running outgoing lines 30 of the low-voltage windings 34 are arranged with an angular offset of approximately 120° based on the circumference in said region.

Furthermore, spacers 38 which are used to electrically separate the low-voltage winding 34 and the high-voltage winding 35 from one another and to obtain the circular shape of the winding 32 are provided in the annular gap 35. At the same time, axially running channels 40 for cooling fluid are also arranged in the annular gap 35, which cooling fluid flows through and in the process absorbs the heat resulting from the current load on the windings 32.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

10 Transformer
11 Transformer
12 Winding
14 Low-voltage winding
16 High-voltage winding
18 High-voltage outgoing line
20 Low-voltage outgoing line
22 Core limb
24 Yoke
28 High-voltage outgoing line
30 Low-voltage outgoing line
32 Winding
34 Low-voltage winding
35 Annular gap
36 High-voltage winding
38 Spacer
40 Cooling channel

What is claimed is:

1. A transformer comprising:

at least one core limb; and three windings arranged beside one another on the at least one core limb, the windings having outgoing lines which are each routed out in a manner so as to be insulated from one another, wherein:

each winding is formed by a low-voltage winding which is close to the core and respectively has an associated high-voltage winding wound around the corresponding low-voltage winding; and the outgoing lines of the low-voltage windings are axially routed out to minimize the lateral distance between the windings.

2. The transformer as claimed in claim 1, wherein the outgoing lines of the low-voltage windings are each routed out parallel to the core limb in a region between the low-voltage winding and the high-voltage winding.

3. The transformer as claimed in claim 1, wherein the outgoing lines of the low-voltage windings are routed out parallel to the core limb in a manner offset by 120° relative to one another based on the circumference of the core limb.

4. The transformer as claimed in claim 1, wherein the outgoing lines of the low-voltage windings are routed out parallel to the core limb on one side.

5. The transformer as claimed in claim 1, wherein the outgoing lines of one low-voltage winding arranged close to a yoke are routed out to one side, and the outgoing lines of the two other low-voltage windings are routed out to the opposite side axially parallel to the core limb.

6. The transformer as claimed in claim 1, wherein the outgoing lines are routed out axially parallel to the core limb and each comprise a shrink tube.

7. The transformer as claimed in claim 1, comprising:

shell-like spacers interposed between the low-voltage windings and the high-voltage windings respectively surrounding the corresponding low-voltage windings, wherein the radial extent of the spacers corresponds approximately to the thickness of an outgoing line, and the spacers produce an annular gap between the low-voltage winding and the high-voltage winding.

8. The transformer as claimed in claim 7, wherein an axially parallel free gap remains for an outgoing line between each of the shell-like spacers interposed between the low-voltage and high-voltage windings.

9. The transformer as claimed in claim 7, wherein each of the shell-like spacers interposed between the low-voltage and high-voltage windings has a width enabling the each of the shell-like spacers to extend over an angular range of less than 120°.

10. The transformer as claimed in claim 7, comprising at least one channel in the annular gap for cooling fluid to flow through.

11. The transformer as claimed in claim 1, comprising:

three core limbs which are each provided with three windings, which are arranged beside one another and are formed from low-voltage windings and high-voltage windings, wherein the ends of the limbs are each connected on both sides by means of at least one yoke.

12. The transformer as claimed in claim 2, wherein the outgoing lines of the low-voltage windings are routed out parallel to the core limb in a manner offset by 120° relative to one another based on the circumference of the core limb.

13. The transformer as claimed in claim 12, wherein the outgoing lines of the low-voltage windings are routed out parallel to the core limb on one side.

14. The transformer as claimed in claim 13, wherein the outgoing lines of one low-voltage winding arranged close to a yoke are routed out to one side, and the outgoing lines of the two other low-voltage windings are routed out to the opposite side axially parallel to the core limb.

15. The transformer as claimed in claim 14, wherein the outgoing lines routed out axially parallel to the core limb each comprise a shrink tube.

16. The transformer as claimed in claim 15, comprising:

shell-like spacers interposed between the low-voltage windings and the high-voltage windings respectively surrounding the corresponding low-voltage windings, wherein the radial extent of the spacers corresponds approximately to the thickness of an outgoing line, and the spacers produce an annular gap between the low-voltage winding and the high-voltage winding.

17. The transformer as claimed in claim 16, wherein an axially parallel free gap remains for an outgoing line between each of the shell-like spacers interposed between the low-voltage and high-voltage windings.

18. The transformer as claimed in claim 16, wherein each of the shell-like spacers interposed between the low-voltage and high-voltage windings has a width enabling the each of the shell-like spacers to extend over an angular range of less than 120°.

19. The transformer as claimed in claim 17, wherein each of the shell-like spacers interposed between the low-voltage and high-voltage windings has a width enabling the each of the shell-like spacers to extend over an angular range of less than 120°.

20. The transformer as claimed in claim 16, comprising at least one channel in the annular gap for cooling fluid to flow through.

21. The transformer as claimed in claim 16, comprising:

three core limbs which are each provided with three windings, which are arranged beside one another and are formed from low-voltage windings and high-voltage windings, wherein the ends of the limbs are each connected on both sides by means of at least one yoke.

* * * * *